US006595606B1

(12) United States Patent
Gunst

(10) Patent No.: US 6,595,606 B1
(45) Date of Patent: Jul. 22, 2003

(54) CASH DISPENSER WITH ROLL-OUT DRAWER ASSEMBLY

(75) Inventor: Robert E. Gunst, Neosho, WI (US)

(73) Assignee: De La Rue Cash Systems Inc., Watertown, WI (US)

( * ) Notice: Subject to any disclaimer, the term of this patent is extended or adjusted under 35 U.S.C. 154(b) by 0 days.

(21) Appl. No.: 10/087,567

(22) Filed: Mar. 1, 2002

(51) Int. Cl.[7] ..... A47B 97/00
(52) U.S. Cl. ..... 312/249.9; 109/24.1
(58) Field of Search ..... 312/249.9, 249.11, 312/293.1, 310, 311, 306, 317.1, 312; 109/2, 24.1; 82/36.1, 67; 271/409, 162

(56) References Cited

U.S. PATENT DOCUMENTS

| | | | | | |
|---|---|---|---|---|---|
| 542,341 | A | * | 7/1895 | Little | 312/198 |
| 1,010,694 | A | | 12/1911 | Shannon | |
| 2,211,308 | A | * | 8/1940 | Wyman, Sr. | 312/317.1 |
| 2,769,676 | A | | 11/1956 | Larsen et al. | |
| 2,923,584 | A | * | 2/1960 | Broderick, Jr. | 312/317.1 |
| 3,101,981 | A | | 8/1963 | McCally | |
| 3,335,326 | A | * | 8/1967 | Bonin et al. | 361/827 |
| 4,318,575 | A | * | 3/1982 | Redlich | 312/249.9 |
| 4,513,670 | A | | 4/1985 | Berman | |
| 4,577,562 | A | * | 3/1986 | Berman | 109/24.1 |
| 4,714,305 | A | | 12/1987 | Service | |
| 4,813,475 | A | * | 3/1989 | Couvrette | 165/223 |
| 4,861,122 | A | * | 8/1989 | Newhouse et al. | 312/330.1 |
| 5,036,779 | A | * | 8/1991 | Capraro | 109/24.1 |
| 5,615,623 | A | | 4/1997 | Capraro, Jr. | |
| 5,813,510 | A | * | 9/1998 | Rademacher | 194/206 |
| 6,123,327 | A | | 9/2000 | Holland-Letz et al. | |
| 6,293,540 | B1 | * | 9/2001 | Kovacs | 271/162 |

FOREIGN PATENT DOCUMENTS

| | | |
|---|---|---|
| DE | 20596 | 11/1956 |
| WO | WO 99/41711 | 8/1999 |

* cited by examiner

*Primary Examiner*—Ramon O. Ramirez
*Assistant Examiner*—Tan Le
(74) *Attorney, Agent, or Firm*—Quarles & Brady LLP

(57) ABSTRACT

A cash dispenser (10) includes a secure enclosure (11, 12, 14) with an enclosure body (11), a door (12) on one side of the enclosure body (11) for opening and closing an access opening (9) into the enclosure (11, 12, 14), a lock (14) for securing the door (11) to the enclosure body (12), and a cash drawer assembly (20) with a plurality of drawers (22) for holding a plurality of denominations of cash. The drawer assembly has a frame with sliding members (28) near the top and wheels (21) at the front for moving the drawer assembly (20) out of the secure enclosure (11, 12, 14) through the access opening (9). The enclosure (11, 12, 14) has a bottom wall (**11*b*) with an aperture (11*d*) therein sized to allow the wheels (21) to rest on a supporting surface (35) for the enclosure (11, 12, 14) and being open to a front side when the door (12) is open, to allow the drawer assembly (20) to be rolled forwardly through the access opening (9) along the supporting surface (35**).

4 Claims, 3 Drawing Sheets

CASH DISPENSER WITH ROLL-OUT DRAWER ASSEMBLY

TECHNICAL FIELD

The present invention relates to secure cash dispensing units used by tellers in banks or used by employees in other businesses for dispensing cash. As used herein, the term "cash" shall refer to either currency alone or currency and coin.

DESCRIPTION OF THE BACKGROUND ART

Automated cash handling equipment is utilized in banking, supermarkets, retail trade and gaming industries and anywhere else where large amounts of cash are handled.

One well known type of teller cash dispenser is used in banks, including drive-in windows, for dispensing cash, predominantly currency, to customers withdrawing cash. These teller cash dispensers are sometimes referred to as teller vaults or as teller security enclosures, depending on the level of security. They provide a sturdy, locked enclosure, like a safe, which is resistant to forcible entries and secure against unauthorized access to the substantial amounts of cash stored therein.

Inside the teller cash dispenser, there is often a drawer assembly with a number of cash drawers for holding different denominations of currency. For example, in the U.S., a six-drawer assembly could be used to hold dollar bills in the amount of $1, $5, $10, $20, $50 and $100. In the UK, the denominations would be in pounds, while in other countries in the European Union, the currency would be in euros.

When the cash drawers are loaded, the drawer assembly can be quite heavy. Typically, the cash dispenser units are serviced through a front door, having a safe-type lock. In that event, the entire drawer assembly is moved forward and out of the unit with the drawers being accessible from the side of the exposed drawer assembly. In a prior commercial unit, the assembly slides out on a mechanism similar to a drawer slide. The guide rails are positioned near the bottom of the drawer assembly, much like a desk drawer. This places considerable weight on the slide mechanism, when the drawers are full, which can make it less than easy to operate in all circumstances. Therefore, the problem to be solved by the invention is to improve the mechanism for allowing the drawer assembly to be withdrawn from the body of the secure enclosure for loading and unloading of cash drawers.

SUMMARY OF THE INVENTION

The invention is provided in a secure enclosure with an enclosure body, a door on one side for opening and closing an access opening into the enclosure, a lock for securing the door to an enclosure body, and a cash drawer assembly with a plurality of drawers for holding a plurality of denominations of cash.

The invention provides a frame as part of the drawer assembly for carrying the drawers, the frame carrying sliding members near the top and at least one rolling device at the front for moving the drawer assembly out of the secure enclosure through the access opening. When positioned in the enclosure the body, the rolling device is received in an aperture in a bottom wall of the enclosure body. Normally, apertures are not favored in such secure containers. In fact, the invention must satisfy UL standards in the U.S. and Canada, which have been provided for such secure enclosures.

In the present invention, the aperture in the bottom wall has been permitted because the enclosure is so secured to a supporting floor that the aperture cannot be accessed or tampered within the security standards set by Underwriters Laboratories. This is a novel and nonobvious solution to the technical problem.

The invention provides a cash dispensing unit for tellers and other employees in which it is easier to move the cash drawer assembly in and out of the secure enclosure. The invention also conserves space within the enclosure. The invention also solves the problem of a lip or drop-off, if the aperture in the bottom wall of the enclosure were not provided.

Other objects and advantages of the invention, besides those discussed above, will be apparent to those of ordinary skill in the art from the description of the preferred embodiments which follows. In the description, reference is made to the accompanying drawings, which form a part hereof, and which illustrate examples of the invention.

DETAILED DESCRIPTION OF THE PREFERRED EMBODIMENT

Figure 1:
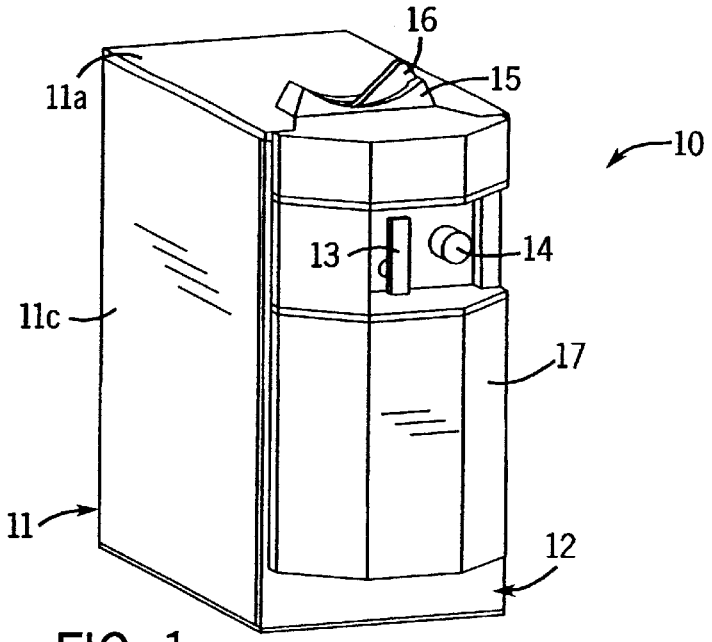
FIG. 1 is a perspective view of a cash dispenser of the present invention with the door closed and locked.

FIG. 1 illustrates a preferred embodiment of a cash dispensing apparatus 10 that incorporates the present invention. The apparatus 10 stands between three and four feet in height and is intended to be used behind a counter in a bank. A teller receives cash from the dispensing apparatus 10 for serving customers, who walk up or drive in to the teller area.

The apparatus 10 has an enclosure body 11 with top, bottom and side walls 11*a*, 11*b* and 11*c*. A front door 12 is attached by hinges (hidden from view) along one side for pivoting from a closed position in FIG. 1 to an open position seen in FIG. 2 to allow access through an access opening 9. The front door 12 has a handle 13 on it and a lock 14 mounted in it to lock the apparatus. The front door 12 has a generally flat front panel (mostly hidden from view) and has a shaped cover piece 17 that is mounted to the front panel of the door 12. Cover pieces of various shapes and sizes are possible and this may change the outward appearance of the apparatus 10. A bezel 15 projects through a top wall 11*a* of the enclosure body 11. The bezel 15 forms a slotted housing for a note dispensing mechanism 16, which can be pivoted to one of two alternate positions to dispense notes towards the left or to the right of the apparatus 10.

Standards for automatic teller equipment are provided as American National Standards (ANSI) with compliance certified by Underwriters Laboratories (UL). This particular apparatus 10 is an automated teller system in compliance with ANSI/UL Standard 291 for a 24-hour service Level 1 security container.

The lock 14 is a lock complying with UL Standard 768 for combination locks or UL Standard 887 for time delay locks. UL Standard 291, paragraph 13.6B provides that a 24-hour service level 1 or level 2 automatic teller machine shall not be equipped with wheels, skids or similar devices, or with features that will assist in engaging lifting devices, unless they can be removed or rendered inoperative after the unit is installed.

Figure 2:
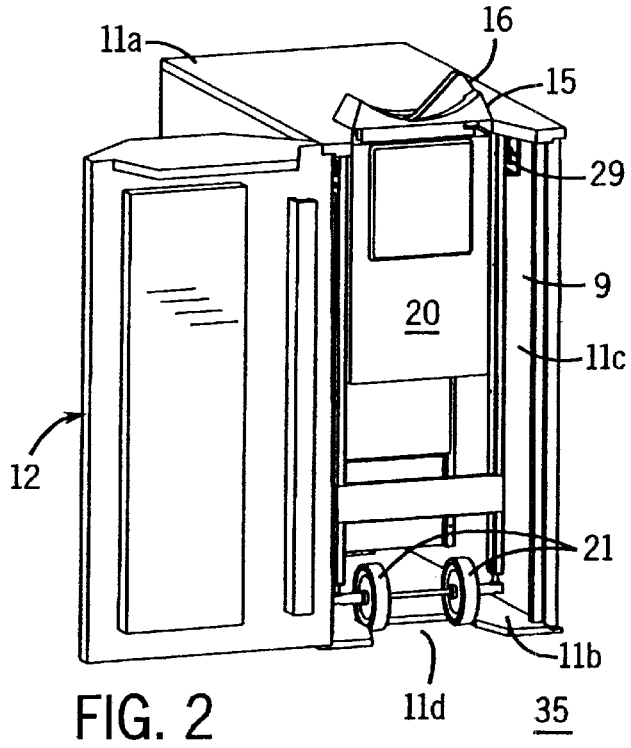
FIG. 2 is a perspective view of the apparatus of FIG. 1 with the door unlocked and opened.

In the present invention, when the door is unlocked and opened as seen in FIG. 2, a carriage drawer assembly 20 can be seen. This assembly 20 includes a pair of front wheels 21 which rest in an aperture lid in a bottom wall 11*b* of the security enclosure 10 so as to contact the floor 35 or a floor covering on which the apparatus 10 is positioned. The bezel 15 and note dispensing mechanism 16 are received in an aperture 11*e* in the top wall 11*a* of the enclosure 10. The wheels 21 will assist the pulling forward of the drawer assembly 20 to a position seen in FIGS. 3 and 4.

It will be apparent to one of ordinary skill in the art that certain modifications might be made to provide equivalents of the wheels, such as a single roller supported centrally on an axle.

Figure 3:
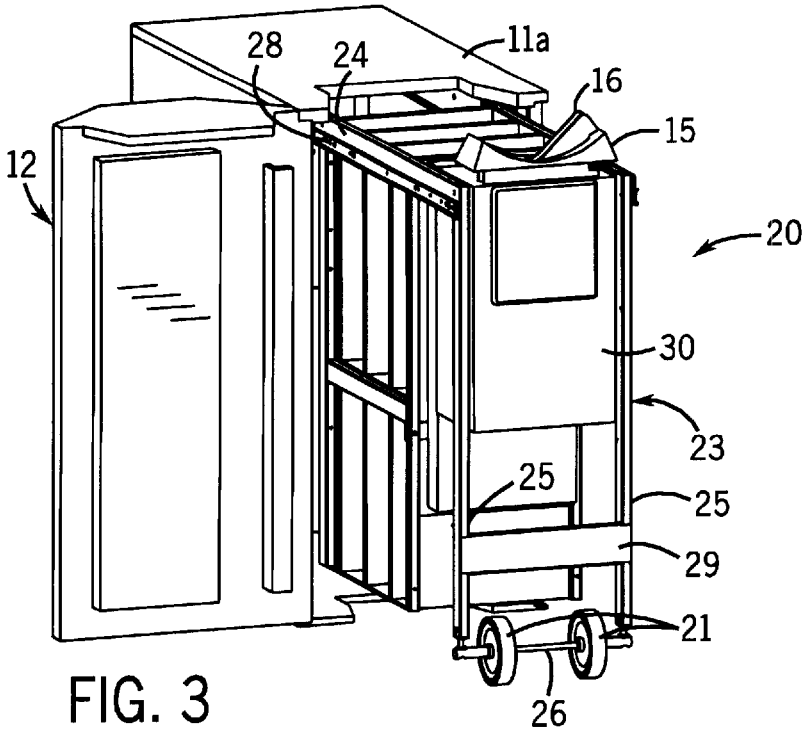
FIG. 3 is a left side perspective of the apparatus of FIG. 1 with a cash drawer assembly pulled out for access.
Figure 4:
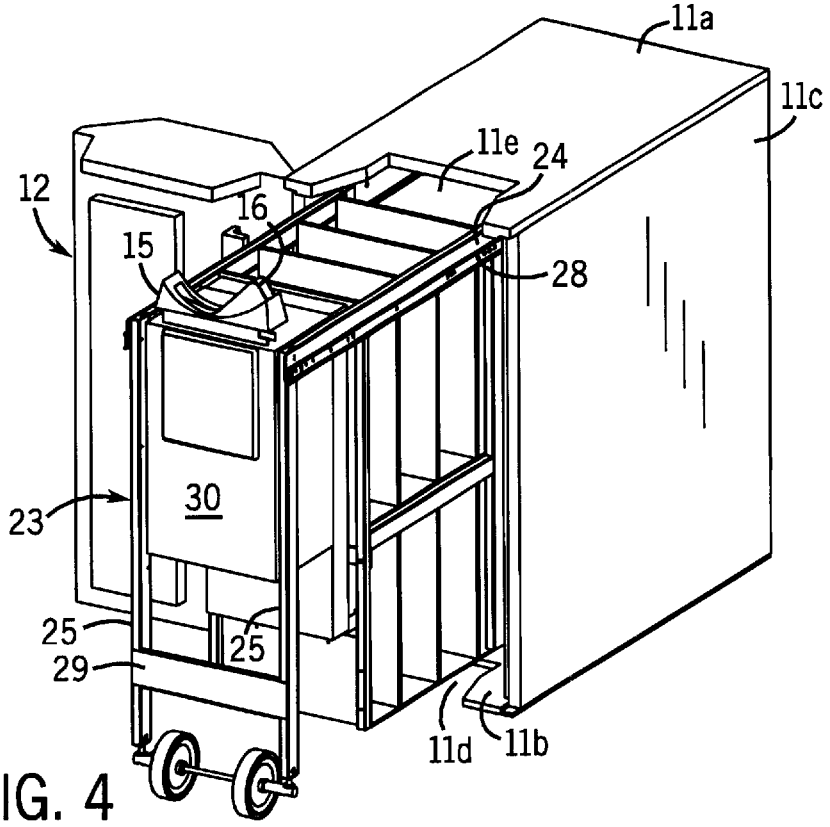
FIG. 4 is a right side perspective of the apparatus of FIG. 3.

As seen in FIGS. 3 and 4, the drawer assembly has a plurality of cash drawers 22 (seen best in FIG. 5) for holding denominations of currency such as $1, $5, $10, $20, $50 and $100 in the U.S. When the drawers are empty, they can be filled with currency and inserted in the drawer assembly, providing that the door to the apparatus 10 is open and the drawer assembly 20 has been pulled out to its extended position. In the UK, the currency denominations would be in pounds, while in other EU countries such as France or Germany, the currency would be in euros. Obviously, the invention is also suitable for many other currencies throughout the world.

The drawer assembly 20 is mounted on a frame 23. The frame 23 has two spaced apart top members 24 disposed horizontally and two spaced apart front members 25 disposed vertically. The wheels 21 are mounted by an axle 26 to lower ends of the front members 25. The front members 25 are braced by cross members 29 and 30.

Figure 5:
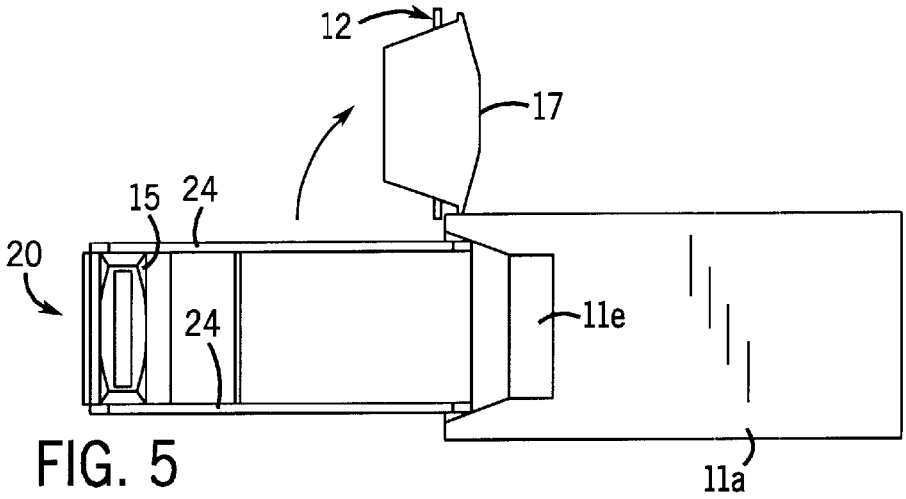
FIG. 5 is a top view of the apparatus of FIGS. 3 and 4.
Figure 6:
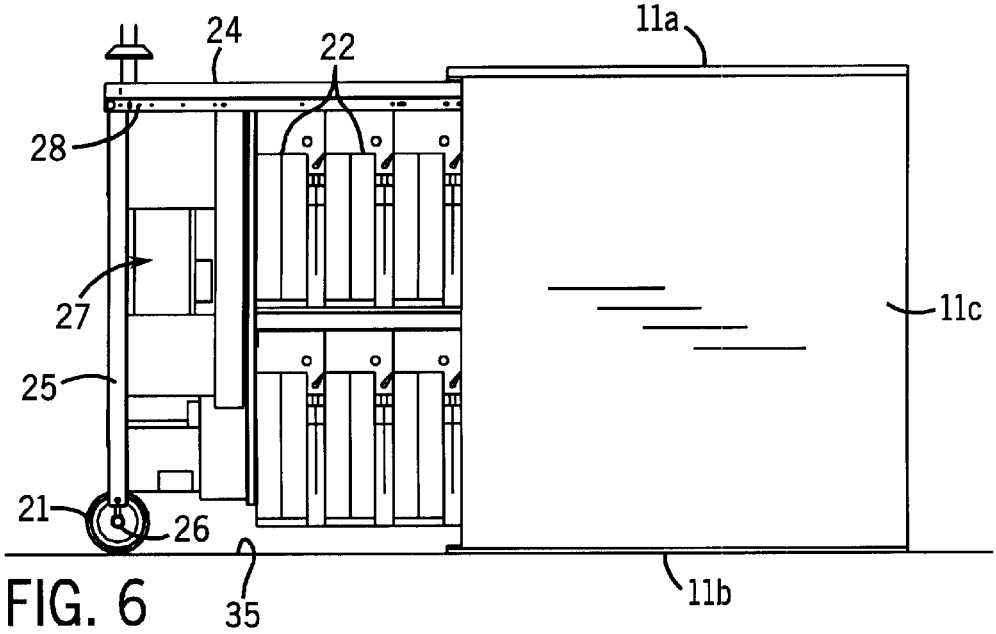
FIG. 6 is right side view in elevation of the apparatus of FIGS. 3 and 4.

Towards the front of the assembly 20, in front of the drawers 22, as seen in FIG. 5, is an electrical control section 27 which includes a motor and electronics for controlling operation of the apparatus 10. The control section 27 may include dials (not shown) for setting the denominations of the currency drawers 22.

At the top of the drawer assembly 20, two slide members 28 are mounted to opposite sides near the spaced apart top members 22. These slide members 28 are parts of two drawer-type slide assemblies each having a pair of complementary sliding members 29 (see FIG. 2). Bearings are included in the slide assemblies and disposed between the sliding members 28, 29. The other sliding members in the assemblies are positioned on the inside of the enclosure body to receive the slide members 28.

In a prior unit, the slide assemblies 28, 29 were mounted near the bottom of the drawer assembly, and in that position carried a substantial load. In the present invention most of the load is transferred through the front members 25 to the wheels 21. This removes load from the slide assemblies 28, 29 and allows for easier movement of the drawer assembly 20 from its enclosed position to its extended and exposed position.

The wheels 21 are intended to roll on the floor 35 or on a floor covering. As a result of the aperture lid, there is no lip for the wheels 21 to travel over and no change of elevation. The aperture lid is just large enough to receive the wheels 21 but not larger than necessary.

To resist lifting or tampering, the enclosure 10 is fastened preferably to the floor 35 of a building in which it is located in accordance with UL Standard 291. It is also possible to be fastened to a 4×8-foot steel plate that is ½-inch thick. The fastening devices for anchoring the apparatus are to withstand a static lifting force of 22,000 lbs. applied in either the horizontal or vertical direction. The anchoring or fastening devices are only be accessible when the door to the apparatus is open.

Figure 7:
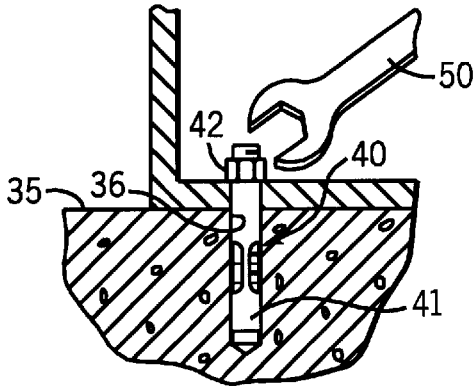
FIG. 7 is a detail sectional of one of the anchoring bolts used to secure the cash dispenser to a floor or other supporting member.

One example of devices suitable for fastening or anchoring the apparatus are shown in FIG. 7. As shown there, one of four identical anchor bolt assemblies 40 which are used, has an expandable jacket 41. The bolt assemblies 40 are inserted through holes 11*e* in the bottom wall 11*c* of the enclosure 11 and into holes 36 drilled into the floor. Each assembly 40 has a head or nut 42 that can be rotated using a tool 50 to expand the jacket 41 and anchor the assembly 40 in the floor. Devices suitable for this use are ⅝-inch diameter anchor bolt assemblies inserted to a depth of 2¾ inches.

Because the apparatus 10 is securely anchored to the floor 35 and is resistant to lifting, the aperture 11*d* is permitted under governing standards. It has been discovered that the aperture 11*d* in the bottom wall 11*b* of the enclosure in combination with top mounting of the drawer slide assemblies 28, 29 provides a drawer assembly 20 which is easier to pull out and push back into the enclosure 10. This provides an automated teller machine that is easier to use and service than known heretofore.

This has been a description of the preferred embodiment and some alternative embodiments. For the embodiments falling within the spirit and scope of the present invention, reference is made to the claims which follow.

I claim:

1. A cash dispenser comprising:

an enclosure with an enclosure body, a door on one side of the enclosure body for opening and closing an access opening into the enclosure, a lock for securing the door to the enclosure body, and a cash drawer assembly with a plurality of drawers for holding a plurality of denominations of cash;

wherein the drawer assembly has a frame for carrying the drawers, the frame carrying sliding members near the top of the drawer assembly and the drawer assembly having at least one rolling device at the front for moving the drawer assembly out of the secure enclosure through the access opening; and wherein the enclosure is a secure enclosure of the type for safeguarding cash, the enclosure having a bottom wall with an aperture therein sized to allow the rolling device to rest on a supporting surface for the enclosure and the enclosure being open to a front side when the door is open, to allow the drawer assembly to be rolled forwardly through the access opening along the supporting surface.

2. The cash dispenser of claim 1, wherein the rolling device is a pair of spaced apart wheels.

3. The cash dispenser of claim 1, wherein the supporting surface is a floor of a building.

4. The cash dispenser of claim 3, further comprising fasteners for anchoring the enclosure body to the floor, said fasteners being at least no. ⅝ inches in diameter, in size, at least four in number and providing a resulting load rating of at least 22,000 pounds.

* * * * *

UNITED STATES PATENT AND TRADEMARK OFFICE

CERTIFICATE OF CORRECTION

PATENT NO. : 6,595,606 B1 
DATED : July 22, 2003
INVENTOR(S) : Robert E. Gunst

It is certified that error appears in the above-identified patent and that said Letters Patent is hereby corrected as shown below:

Column 3,
Lines 14 and 66, “lid” should be -- 11d --.

Column 4,
Line 1, “lid” should be -- 11d --.

Signed and Sealed this

Eighteenth Day of November, 2003

JAMES E. ROGAN
*Director of the United States Patent and Trademark Office*